United States Patent [19]

Korchinski et al.

[11] Patent Number: 4,800,599

[45] Date of Patent: Jan. 31, 1989

[54] SOMATIC SUPPORT SYSTEM

[76] Inventors: Vernard S. Korchinski; Korchinski N. Paul, both of 11777 Indian Ridge Rd., Reston, Va. 22091

[21] Appl. No.: 93,780

[22] Filed: Sep. 8, 1987

[51] Int. Cl.[4] ..... A61G 7/02; A47B 83/02

[52] U.S. Cl. ..... 5/68; 5/90; 5/507

[58] Field of Search ..... 5/63, 66, 67, 68, 69, 5/90, 507

[56] References Cited

U.S. PATENT DOCUMENTS

| | | | |
|---|---|---|---|
| 100,324 | 3/1870 | Reid | 5/67 |
| 213,706 | 3/1879 | King | 5/67 |
| 542,994 | 7/1895 | Richard et al. . | |
| 594,846 | 12/1897 | Bennett . | |
| 1,018,195 | 2/1912 | Kemmler . | |
| 1,731,251 | 10/1929 | McIntosh . | |
| 3,246,540 | 4/1966 | Pickles | 5/68 |
| 3,654,643 | 4/1972 | Clanan | 5/90 |
| 3,678,519 | 7/1972 | Szucs . | |
| 3,693,200 | 9/1972 | Stafford | 5/68 |
| 3,717,376 | 2/1973 | Lutchansky . | |
| 3,875,598 | 4/1975 | Foster et al. . | |
| 3,886,610 | 6/1975 | Shelden . | |
| 4,083,068 | 4/1978 | Böhme . | |
| 4,087,872 | 5/1978 | Smirle . | |
| 4,195,375 | 4/1980 | Paul . | |
| 4,255,988 | 10/1980 | Cary et al. . | |
| 4,277,858 | 7/1981 | Böhme . | |
| 4,357,722 | 11/1982 | Thompson . | |
| 4,406,027 | 9/1983 | Bourda . | |
| 4,435,861 | 3/1984 | Lindley . | |
| 4,435,862 | 3/1984 | King et al. . | |
| 4,589,151 | 5/1986 | Behrens . | |
| 4,654,904 | 4/1987 | Britz | 5/90 |

OTHER PUBLICATIONS

Life Line products brochure.

*Primary Examiner*—Reinaldo P. Machado
*Attorney, Agent, or Firm*—Jones, Tullar & Cooper

[57] ABSTRACT

A somatic support system for the total support of a bed-dependent person includes a multi-section mattress support frame assembly which is carried by a vertically movable body lift frame assembly. A quickly detachable modular power unit is carried by a unit frame assembly and operates the body lift frame which is also carried by the unit frame and within a surrounding panel assembly. The mattress support frame assembly itself is infinitely adjustable by operation of the power unit and allows the bed-dependent person to be placed in any of a number of positions. Various adjuncts for use in the care of the bed-dependent person are useable with the somatic support system.

30 Claims, 9 Drawing Sheets

20
26
28
22

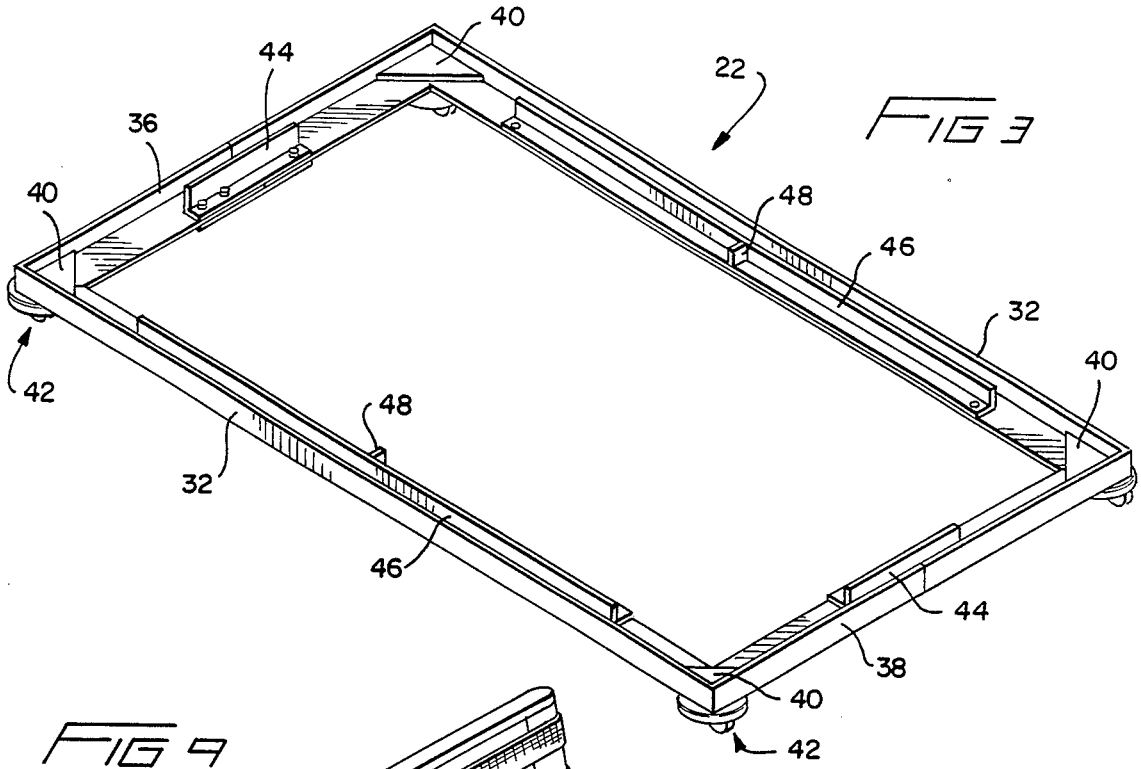
FIG 3
FIG 9
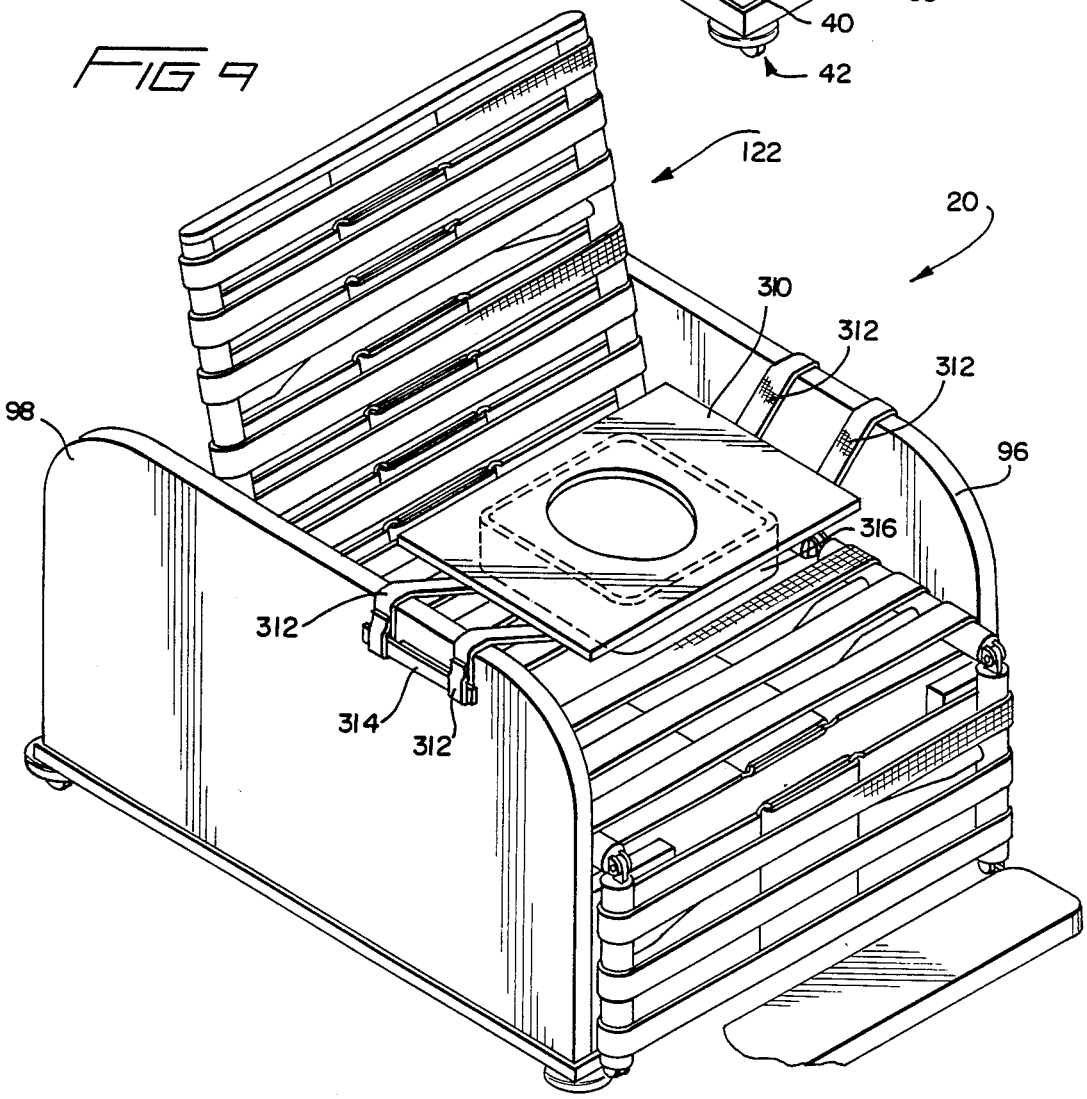

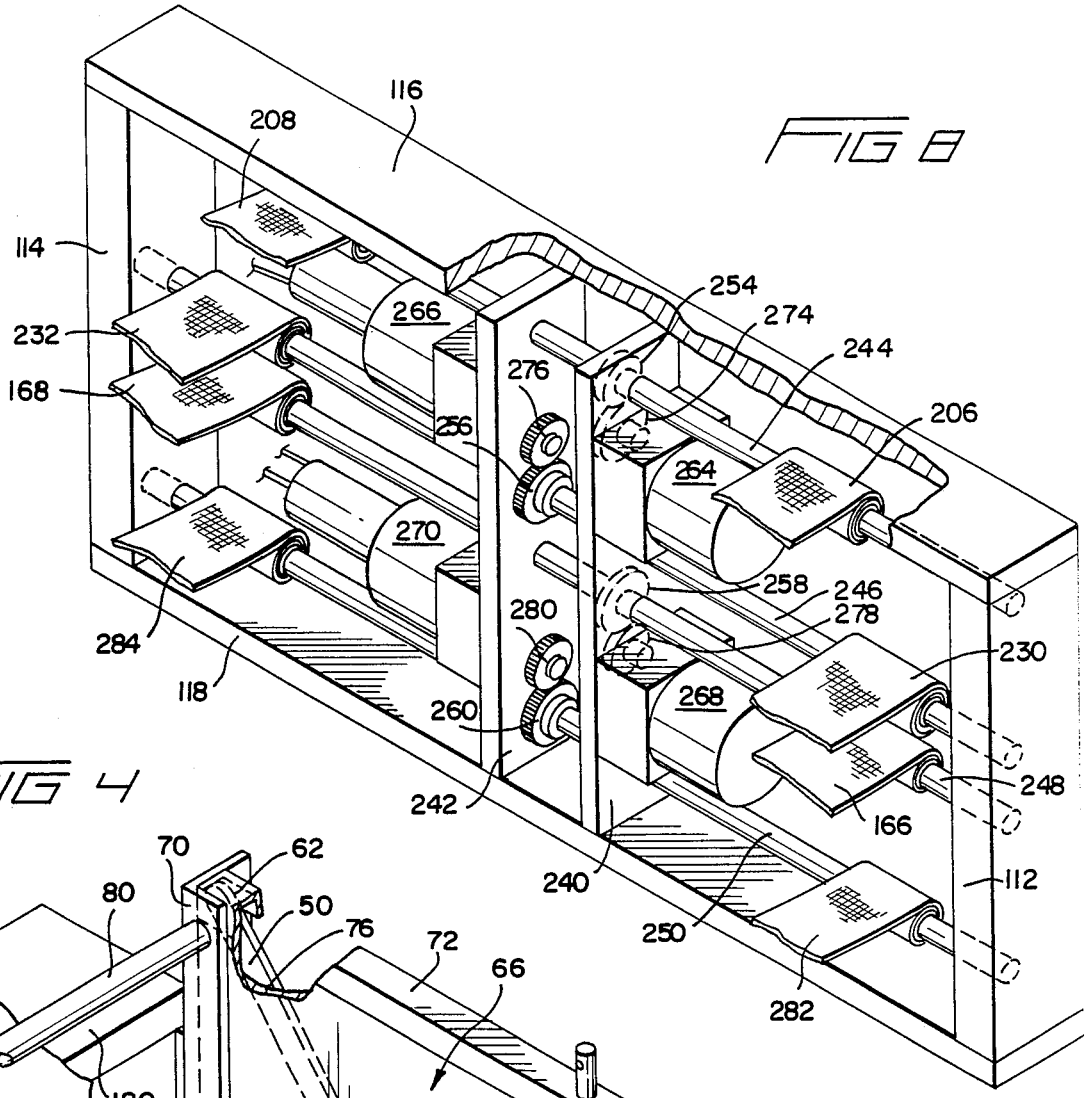
FIG 8
FIG 4
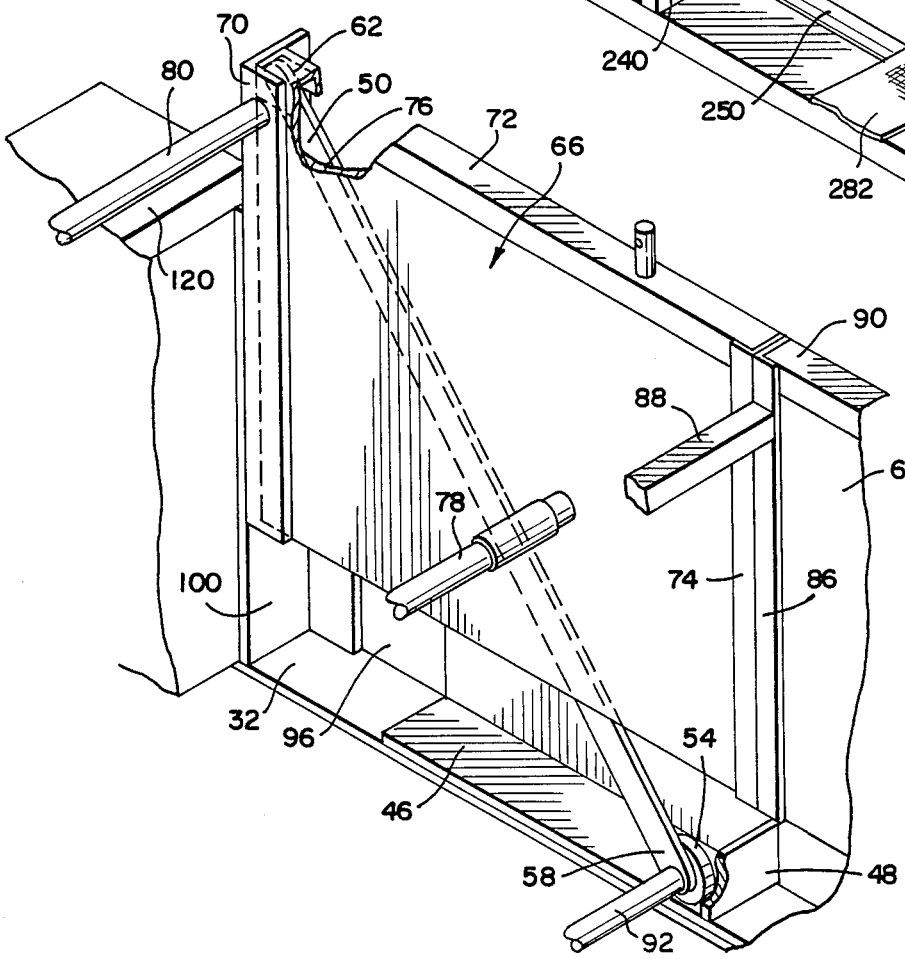

SOMATIC SUPPORT SYSTEM

FIELD OF THE INVENTION

The present invention is directed generally to a somatic support system. More particularly, the present invention is directed to a infinitely variable body support assembly. Most specifically, the present invention is directed to an infinitely variable, modular body support system. The somatic support system allows the person being supported to be placed in an infinite variety of positions by using this modular, transportable unit which ideally suited for in home or nursing care use. The somatic support system is additionally capable of attaining recliner chair and upright chair positions. Furthermore, various adjuncts, such as a commode seat or a work platform can be utilized with the somatic support system to provide a unit which will facilitate the complete care and support of a bio-dependent person while at the same time being transportable and movable within a home or care facility.

DESCRIPTION OF THE PRIOR ART

Various adjustable hospital bed assemblies are well known in the art. These assemblies typically are intended for in-hospital useage and have heavy frame and mattress assemblies. In a generally conventional hospital bed, the frame assembly may be moved in one or two directions such as elevating or lowering either a head or a leg section or possibly alternatively raising or lowering the entire mattress supporting frame. These hospital beds are usually powered by one or more electric motors which are operable by a nurse or aide to vary the position of a patient being supported.

A typical hospital bed is structured to be placed in a room and not moved. Thus it is usually a relatively heavy, immobile unit. Additionally, the typical hospital bed is not designed or intended for long term patient occupancy. Thus, while it is suitable for supporting a patient during his hospital stay, it is not intended, and does not function well as a long term support for a bedridden patient such as one who might be confined to a bed in a nursing home or in an in-home care situation. However, in the absence of a more suitable alternative device, these typical,heavy, cumbersome hospital beds have been used, with limited success, in non-hospital situations.

When a person is confined to a bed for both waking and sleeping hours, it is important that his support system be varied as often and into as numerous a variety of positions as possible. In an attempt to do that, a number of various bed assemblies have been utilized. While these may not be as heavy and cumbersome as the conventional prior hospital beds, these prior long term beds, have also not been completely satisfactory. They may have more degrees of freedom of movement than does a typical hospital bed, but they do not provide the virtually infinite number of positions that are truly necessary for proper support and care of a bed-dependent person.

When a person is bedridden or bed restricted, various care functions must be performed both to the person and to the bed system itself. The patient or bedridden person must be bathed, clothed or dressed and his bodily wastes must be disposed of. The bed itself must have sheet changes, mattress pad changes, and in some instances mattress changes. In the prior art devices all of these patient and bed changes have been accomplishable in a rather labor intensive and often difficult manner. For instance, a substantial amount of patient shifting is usually required for bed pan useage, for bed linen changes, and the like. The person must be lifted, turned, rolled, raised, lowered and generally moved about in the bed to allow his routine needs and care to be accomplished. Such moving and shifting is apt to be quite labor intensive, particularly when caring for a large person or one who may be incapable or only partially capable of moving himself. Additionally, there is always a risk or patient injury during each moving and shifting.

The prior art hospital beds and various extended care beds that are presently available are not intended to be readily movable. While they may be provided with caster wheels so that they can be periodically moved within a room, they are not intended, or suitably constructed to be quickly and easily taken apart and set up. Thus it is not possible for a bedridden person to be shifted from room to room or to be taken out of the home in a typical bed assembly. Additionally, the conventional hospital bed and long term bed assemblies cannot be easily transported or shipped. Thus it is again extremely difficult for a bedridden person to be moved from place to place unless prior plans are made to provide a bed at the person's destination. Once the presently available beds have been received from the manufacturer and have been assembled, they are not designed to be frequently taken apart and moved.

Although most manufacturers attempt to make their products as durable and reliable as possible, it is inevitable that components will break and parts will wear out and need to be replaced. In a hospital, it is usually possible to find a space bed. In a nursing home, it may be possible to find a spare. In a home care situation, the luxury of a spare bed is not usually available. In any case, durability and ease of servicing are important considerations. While no manufacturer would knowingly construct a unit that is difficult to fix or maintain, the fact remains that presently available patient support devices are apt not to have been designed with these considerations in mind.

As will be appreciated, the presently available patient support beds have a number of limitations that have detracted from their suitability for use as long term patient or occupant support devices. At best, these prior devices have been adaptations or modifications of generally conventional hospital beds. As such they have been less than satisfactory in satisfying the needs of a long term bedridden person who may desire home care. Thus the need exists for a new somatic support system which is structured and operable to satisfy the needs of this type of person. The somatic support system of the present invention provides such a device.

SUMMARY OF THE INVENTION

It is an object of the present invention to provide a somatic support system.

Another object of the present invention is to provide an infinitely variable body support assembly.

A further object of the present invention is to provide a modular body support assembly.

Yet another object of the present invention is to provide a somatic support system that is readily transportable.

Still a further object of the present invention is to provide a somatic support system having a multiple section mattress support frame.

Even yet another object of the present invention is to provide a somatic support system which is useable with various patient care adjuncts.

Yet still a further object of the present invention is to provide a somatic support system having quickly replaceable components.

An even further object of the present invention is to provide a somatic support system which is efficient, durable and easy to maintain.

As will be discussed in greater detail in the description of the preferred embodiment which is set forth subsequently, the somatic support system of the present invention is intended to provide a total body support unit which is able to assume an infinite number of positions; which is modular and light weight for ease of movement, shipping and transport; and which is structured, built and intended specifically to provide a long term support system for a bed-ridden or bed-dependent individual. This is accomplished by utilizing a multi-section mattress support frame which is carried by spaced sides of a body lift frame that is, in turn supported between side panels carried by a unit support frame. The mattress support frame is composed of five sections, each of which is joined either to another mattress support frame section or to the body lift frame. This body lift frame is raisable and lowerable within the side panels to raise or lower the mattress support frame as a unit. this allows the somatic support system's occupant to be placed at bed height, gurney or stretcher height, or any place between. Independently, the several sections of the mattress support frame can be individually adjusted to position the sections of the mattress support frame in any desired position.

The body lift frame and the mattress support frame of the somatic support system of the present invention are raised by elongated lift straps which are attached at first ends to lift rods which extend between lift bars and which are attached at second ends to rotatable shafts in a modular power unit. As the lift straps are wound on their shafts, the various somatic support system components are raised. The lift straps are unrolled from the shafts when the support system components are to be lowered. This support system thus allows infinite positioning of the somatic support assembly.

In contrast to the prior art hospital beds and the modified versions thereof which are currently used in nursing care facilities and at home, the somatic support system of the present invention is particularly suited for long term patient care. It can adjust to a full upright chair or to a recliner chair position, in contrast with prior art devices which do neither. As such, it is much more able to provide a comfortable, long-term support structure for a bed-ridden person. This support system is also readily able to support the person on a commode seat or when it is necessary to elevate the patient from the mattress surface such as during linen changes. Additionally, once the person has been elevated, the mattress can be removed from the frame and the person can be bathed without soiling the bed linen or the mattress. Further, if the somatic support system is put into a chair-like configuration, an auxiliary work platform can be attached for use as a table at mealtimes or for other activities. Again, these capabilities are simply not provided by prior art hospital bed assemblies.

The somatic support system of the present invention is easily transported and shipped. It can be taken apart and packed for shipment in several containers that are small enough to fit into the truck of a car or to be readily accepted by an airline or parcel service. This means that the support system can travel with the patient or bed-dependent person and thus means that the person need not make elaborate plans to insure that a suitable bed will be available at his destination. Although virtually any assembly can be taken apart and shipped, the somatic support system of the present invention is structured and configured to make such a task accomplishable with a minimum of work and time while requiring few if any tools.

The somatic support system of the present invention is not a hospital bed that has been modified in an attempt to provide a long term patient support device. Instead, it is a new and unique support system which provides total body support to a bed-dependent person in a manner that is much more comfortable for the user than prior devices while at the same time facilitating patent care as well as simplifying care of the support assembly itself. The somatic support system is light weight, durable, easily taken apart and shipped: quickly erectable in the field with few or no tools, and specifically designed for low maintenance and ease of service. As will be more fully discussed shortly, it is a substantial improvement over prior devices and represents a significant advance in the art.

BRIEF DESCRIPTION OF THE DRAWINGS

While the novel features of the somatic support system in accordance with the present invention are set forth with particularity in the appended claims, a full and complete understanding of the invention may be had by referring to the detailed description of the preferred embodiment, as presented subsequently, and as is illustrated in the accompanying drawings in which:

FIG. 3 is a perspective view of the unit frame assembly for the somatic support system;

FIG. 4 is a partial perspective view of a portion of the body lift frame supported on the unit support frame and showing a body lift bar;

FIG. 8 is a perspective view of the modular power unit for the somatic support system of the present invention;

FIG. 9 is a perspective view of the somatic support system in a chair configuration and utilizing a commode seat adjunct;

DESCRIPTION OF THE PREFERRED EMBODIMENT

Figure 1:
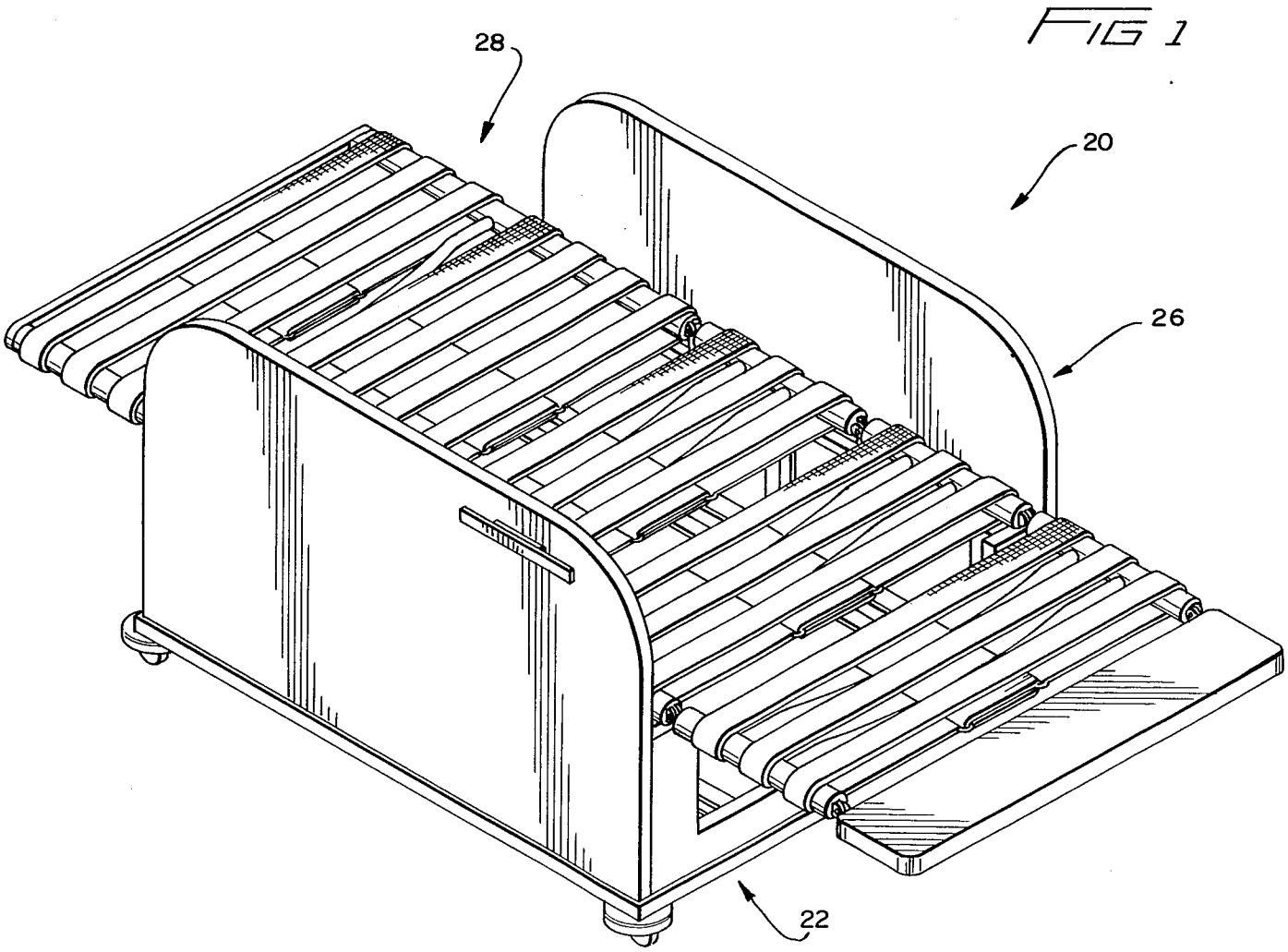
FIG. 1 is a perspective view of the somatic support system of the present invention and showing the mattress support frame in a planar, lowered orientation.

Referring initially to FIG. 1 there may be seen, generally at 20, a preferred embodiment of a somatic support system in accordance with the present invention. As may be seen in FIG. 1 and also in exploded perspective in FIG. 2, somatic support system 20 is comprised of a plurality of cooperating subassemblies which include; a unit frame assembly 22; a body lift frame assembly 24 which is movable vertically with respect to unit frame assembly 22 and which is positioned within a panel assembly 26; a mattress support frame assembly generally at 28 which is carried generally atop body lift frame assembly 24; and a modular power unit 30 which provides the power to operate the somatic support system. While each of these assemblies will be discussed in detail shortly, it may be seen at this point that unit frame assembly 22 provides a base for somatic support system 20 and that the body lift frame assembly 24 is supported above unit frame 22 and is moved vertically within panel assembly 26 to raise and lower the multiple section mattress support frame assembly 28 generally up or down. Mattress support frame assembly is formed of preferably five individual sections and these are operable by modular power unit 30 to allow the somatic support system 20 to assume an infinite number of positions, some of which are illustrated, by way of example in FIGS. 11–16.

Figure 2:
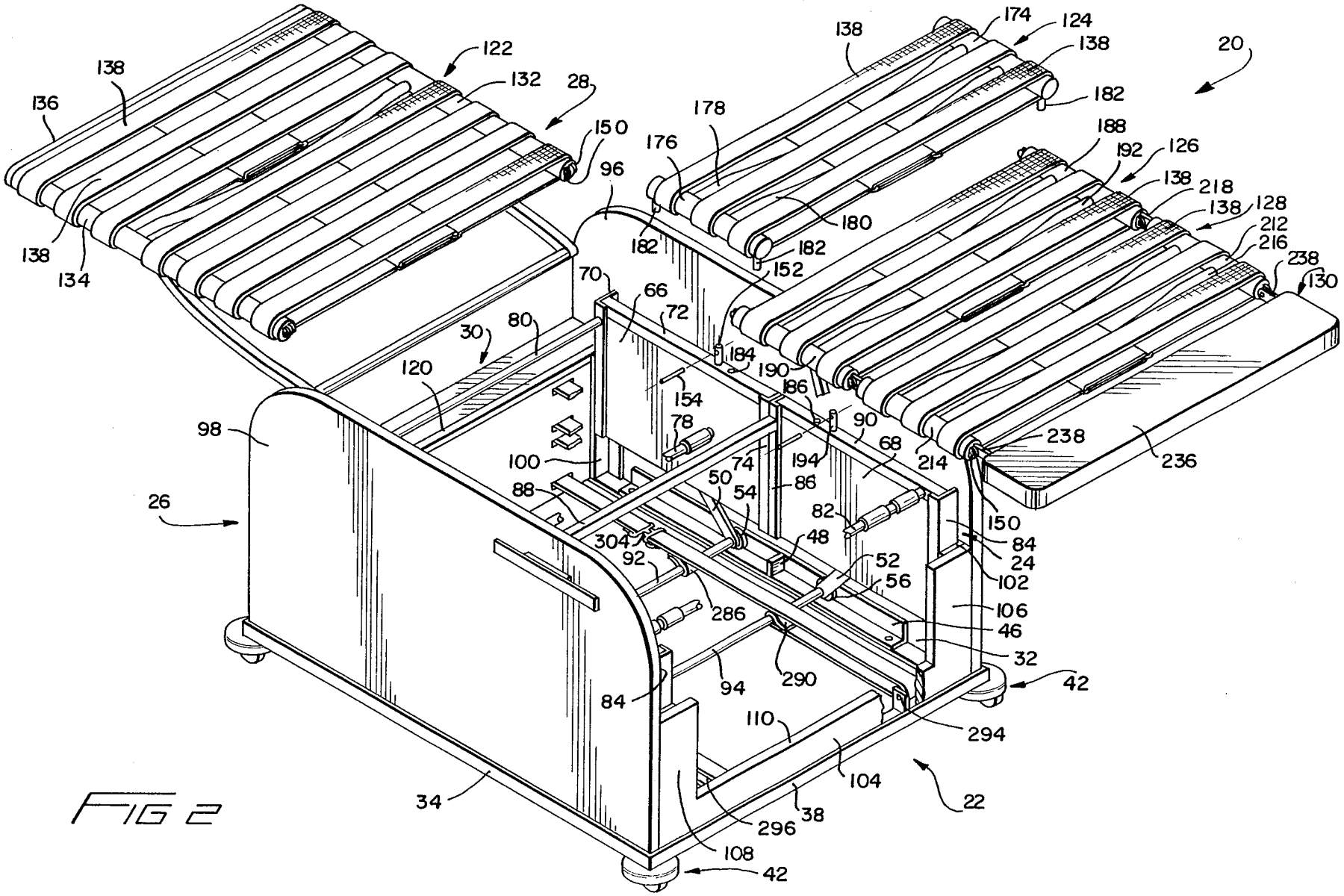
FIG. 2 is an exploded perspective view and showing the mattress support frame separated from the body lift frame.

Referring now to FIG. 3, in conjunction with FIGS. 1 and 2, unit frame assembly 22, which forms the base of the somatic support system 20 of the present invention, is formed generally as a rectangular unit having a right unit frame rail 32, a left unit frame rail 34, a head unit cross rail 36, and a foot unit cross rail 38. These various rails 32, 34, 36 and 38 may be made of angle iron or a similar material having sufficient strength and rigidity to support the somatic support system 20 and an occupant. To provide added strength and rigidity, a plurality of gusset plates 40 may be secured at the four corners of the unit frame assembly 22. Suitable caster wheel assemblies 42 are attachable to the unit frame assembly 22 generally at the four corners and beneath gusset plates 40. These caster wheel assemblies 42 are generally conventional, may be removably attached, if desired, and may be provided with bumper guards to cushion any impacts that the wheel assemblies may have with door casing, baseboards and the like. Preferably these caster assemblies 42 will have bearing mounted wheels and may also be equipped with brakes so that the somatic support system 20 is easily rolled about yet can be locked in place.

Head unit cross rail 36 and foot unit cross rail 38 may be divided generally at their midpoints and joined by cross rail connectors 44 which may be attached to cross rails 36 and 38 by any conventional manner. This allows unit frame assembly 22 to be divided into two parts for ease in shipping and handling.

A roller guide rail 46 is welded or otherwise permenently secured to the interior of each of the right and left unit frame rails 32 and 34, as may be seen in FIGS. 3, 2, 4, and 5. Each roller guide rail 46 is divided at generally its midpoint by a roller guide rail stop plate 48. These roller guide rails 46 are provided to add additional strength to the frame ends 32 and 34 and further to provide tracks for body lift bars, as will be discussed shortly, to ride on.

As may be seen most clearly in FIGS. 2 and 4, body lift frame assembly, generally at 24 is supported above unit frame assembly 22 and is movable vertically with respect thereto by front and rear body lift bars 50 and 52. Each of these lift bars 50 and 52 has a roller 54 and 56, respectively at its lower end 58 and 60, respectively. These rollers 54 and 56 ride on the unit frame roller guide rails 46. Upper ends 62 and 64 of head and rear body lift bars 50 and 52, respectively are receivable in upper interior corners of hollow front and rear body lift frame segments 66 and 68. thus as the front and rear body lift bar rollers 54 and 56 are moved away from each other, and away from roller guide rail stop plate 48 along roller guide rail 46; thereby causing front and rear body lift bars 50 and 52 to assume more vertical orientations, the body lift frame assembly 24 is caused to move vertically upwardly with respect to unit frame assembly 22, with this movement being held in a vertical path by cooperation between body lift frame assembly 24 and panel assembly 26.

Figure 5:
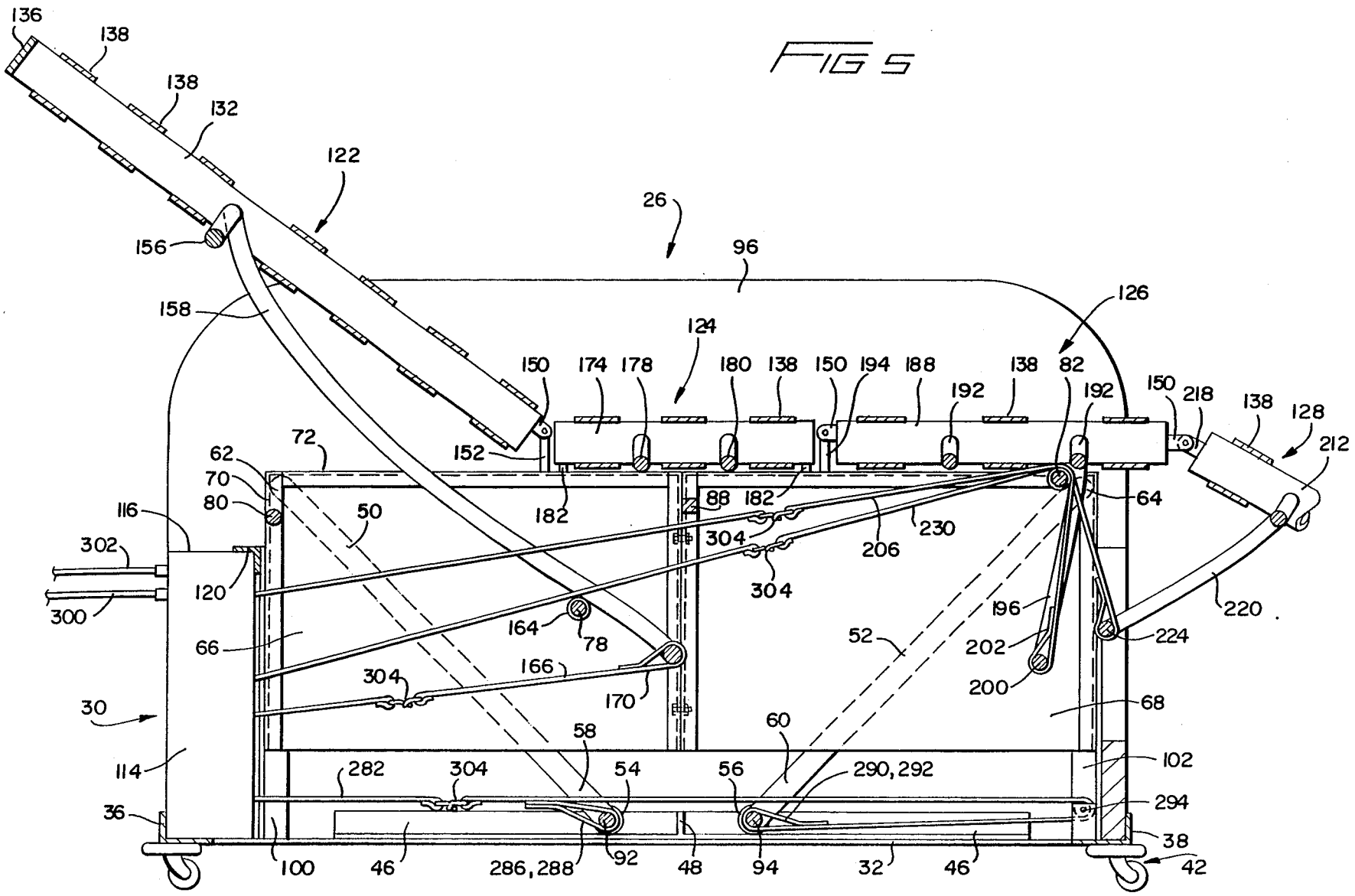
FIG. 5 is a side view, partly in cross section of the somatic support system and showing the paths of the lift straps.

Body lift frame assembly 24 is, as was alluded to previously, comprised primarily of hollow front and rear body lift frame segments 66 and 68. While only the right side frame segments 66 and 68 are shown in FIGS. 2, 4 and 5, it will be understood that the left side units are substantially the same. As may be seen most clearly in FIG. 4, each body lift frame segment, such as front right segment 66 is formed by a framework of a front outwardly opening angle member 70, a top downwardly opening channel member 72, and a rear, forwardly opening angle member 74. These three body lift frame segment members 70, 72, and 74 may be welded or otherwise permanently joined to each other. A may be seen in FIG. 4, the intersection of the upper end of front angle member 70 with the forward end of top channel member 72 forms a pocket that receives the upper end 62 of the front body lift bar 50. This upper end 62 is freely receivable in this pocket and is pivotable within it as is necessary to allow the angle of inclination of body lift bar 50 to change as the body lift frame assembly 24 is raised or lowered.

A face sheet 76 is attached to the three body lift frame segment members 70, 72, and 74 to add rigidity to the front body lift frame segment 66; to insure that no bedding material or patient limbs can come into contact with body lift bar 50; and to serve as attachment for a transverse front intermediate body lift frame tie bar 78. This tie bar 78 and a similar front body lift frame tie bar 80 extend transversely across between the right and left front body lift frame segments 66, as may also be seen in FIG. 2. Front tie bar 80 is attached at its ends to front outwardly opening channel members 70, generally adjacent it supper end, and a similar rear body lift frame tie bar 82 is attached at its ends to the rear of the top downwardly opening channel member 90 of hollow rear body lift frame segment 68. Also extending between front, rearwardly opening angle members 86 of hollow rear body lift frame segment 68 is a central body lift frame tie bar 88. Tie bar 88 is secured to rear segment 68 as opposed to front segment 66 since the front segment already includes tie bars 78 and 80.

The hollow front and rear body lift frame segments 66 and 68 are releasably joined to each other by attachment of angle members 74 and 86 to each other by suitable quick release means such as head and slot cooperating devices. This allows these two frame segments to be taken apart from each other once the body lift frame assembly 24 has been lifted sufficiently to allow the upper ends 62 of body lift bars 50 and 52 to drop out of their pockets at the intersection of members 70 and 72; and 84 and top downwardly opening channel member 90 on hollow rear body lift frame segment 68. In a similar manner, the several transverse tie bars 78, 80, 82, and 88 can be provided with headed ends that are received in cooperating slots so that these bars can be removed. Alternatively, other connecting means can be used so long as they are able to be taken apart. The lower ends 58 and 60 of the right front and rear body lift bars 50 and 52, respectively are connected to their counterpart left side lift bars (not shown) by front and rear lift bar tie rods 92 and 94, respectively.

The various lift frame assembly tie bars 78, 80, 82, and 88 insure that the spacing of the body lift frame assembly 24 will be properly maintained once the weight of a person is placed on a mattress which would be positioned atop mattress support frame assembly 28. This weight would tend to collapse the two spaced body lift frame segments on each side inwardly toward each other and this is prevented by the tie bars 78, 80, 82, 88. Any outward movement of the components of the body lift frame assembly 24 is also prevented by the tie bars 78, 80, 82 and 88, and is further prevented by the panel assembly 26 which also provides guides for the vertical movement of body lift frame assembly 24. As may best be seen in FIG. 2, a right side outer panel 96 and a left side outer panel 98 have lower ends which are receivable in the right and left unit frame rails 32 and 34 of unit frame 22. These panels have a thickness selected so that they will fit between the upstanding walls of frame rails 32 and 34 and the inwardly spaced upstanding walls of the roller guide rails 46. These spaced walls effectively form a channel into which the lower edge portions of the outer side panels 96 and 98 slidingly fit. Each outer side panel 96 and 98 has secured thereto a head or forward end guide angle member 100 and a foot or rear guide angle member 102. As may be seen most clearly in FIG. 4, the forward guide angle member 100 on right side panel 96 forms a guide for controlling the vertical travel of front angle member 70 of the front body lift frame segment 66 of body lift frame assembly 24. Similarly, rear guide angle member 102 cooperates with rear angle member 84 on rear body lift frame segment 68. These two guide angle members 100 and 102 thus provide at rack or channel, with the interior surface of right outer panel 96 within which the body lift frame assembly 24 can move vertically up and own.

A rear panel support frame 104 is part of panel assembly 26, and as may be seen in FIG. 2, extends transversely across the rear or foot end of unit frame 22. This rear panel support frame 104 is also of a thickness so that it will fit between a rear wall portion of foot unit cross rail 38 and the upwardly spaced rear frame cross rail connector 44. Rear panel support frame 104 is generally U-shaped and has spaced, inwardly extending legs 106 and 108. As is shown in FIG. 2 right leg 106 abuts the inner surface of the rear portion of right side outer panel 96. Although not as clearly shown, the left leg 108 of U-shaped rear panel support frame 104 cooperates in a similar manner with the left side outer panel 98. These two legs 106 and 108 are spaced from each other and connected by a central web 110 which defines their spacing. Together, right and left side outer panels 96 and 98, together with rear panel support frame 104 interfitting in unit frame assembly 22 form a strong box-like outer element for the somatic support system of the present invention.

Modular power unit 30 is carried at the head end of unit frame assembly 22. While a discussion of this unit's operation will be deferred a this point, its structure may be seen in FIGS. 2, 4 and 5 to be generally complementary to that of rear panel support frame 104. Modular power unit 30 is generally in the shape of a hollow box that includes s paced right and left side walls 112 and 114, as seen most clearly in FIG. 8, an upper wall 116 and a lower wall 118. This modular power unit 30 is dimensioned so that its depth is the same as the spacing between a front portion of forward guide angle members 100 on right and left outer panels 96 and 98, and upstanding wall portion of head unit cross rail 36. While not specifically shown, it will be understood that bottom wall 118 of power unit 30 will be suitably cut out to avoid interference with front unit frame cross rail connector 44. Similarly, the width of power box 30, as determined by the upper and lower box walls 116 and 118 will be the same as the width of U-shaped rear panel support frame 104. Once modular power box 30 has been slid downwardly into place at the head end of unit frame assembly 22, it may be held in place by a slidable angle bar 120 that could carry locking projections which would engage suitable cooperating slots in forward guide angle members 100 on right and left side outer panels 96 and 98. This placement of modular power box 30 at the head end of unit frame 22, and in contact with outer side panels 96 and 98 further strengthens the somatic support system 20.

Mattress support frame assembly, generally at 28 is, as may be seen most clearly in FIGS. 2 and 5 formed preferably as a group of five sections. These are a head support section 122, a body support section 124, a knee support section 126, a leg support section 128, and a foot support section 130. Each of these sections will now be individually discussed in terms of structure and attachment of body lift frame assembly 24 as well as to each other. It will be remembered however that these five sections or segments cooperate and operate together to form a support for a mattress, or in some cases directly for a patient, and that they all work together to form this support. Further since all but the foot support sections are preferably structured essentially in the same manner, only the structure of the head support will be discussed in detail.

Hear support section 122 is formed of right and left elongated support section side tubes 132 and 134. These side tubes 132 and 134 are typically formed of a hollow, light weight material such as metal, plastic or the like and may be provided with a wear-resistant, non-permeable surface which would be suited for use in a patient care situation. A generally flat end bar 136 extends across between the upper or head ends of spaced side tubes 132 and 134. The spacing of these side tubes is selected to cooperate with the spacing between the outer panels 96 and 98 so that the mattress support frame assembly will be securable to body lift frame assembly 24 and movable vertically with it without interfering with outer panels 96 and 98. A plurality of spaced, fabric support webs 138 are placed about the spaced right and left side tubes 132 and 134. These webs are made of a high strength, light weight webbing material and an be periodically removed and cleaned or replaced. These webs 138 are not particularly resilient but can stretch and deform in response to the amount of weight placed on them due to their resilient connecting arrangement. As may be seen most clearly in FIG. 6, each end of each fabric support web 138 terminates in a sewn-in loop 140 which encircles a first leg 142 of a metal ring 144. A resilient strap 146 is fed through ring 144 and encircles an inner second leg 148. While not specifically shown, it will be understood that resilient strap 146 is not a continuous loop but is an elongated strip which is removable from at least one of the metal rings 144 carried at the ends of fabric web straps 138. Thus each fabric support web 138 can be removed by disconnection of the resilient strap 146 from one of the metal rings 144. Further, the resiliency of resilient strap 146 can be selected in accordance with the expected weight load that will be placed at specific parts along each of the four similar mattress support section 122, 124, 126, and 128. In this way, the patent will be comfortably supported along the length of his body.

Each of the head section side tubes 132 and 134 is provided with spaced pivot ears 150 at their ends opposite to head section end bar 136. These pivot ears 150 are attachable to pivot posts 152 that are welded or otherwise attached to the top, downwardly opening channel members 72 of the right and left hollow front body lift frame segments 66. Once the pivot ears 150 have been placed on wither side of each pivot post 152, a suitable pivot pin 154 is inserted through aligned apertures in the ears and post. Thus mattress support frame head section 122 is pivotably attachable to body lift frame assembly 24.

Figure 6:
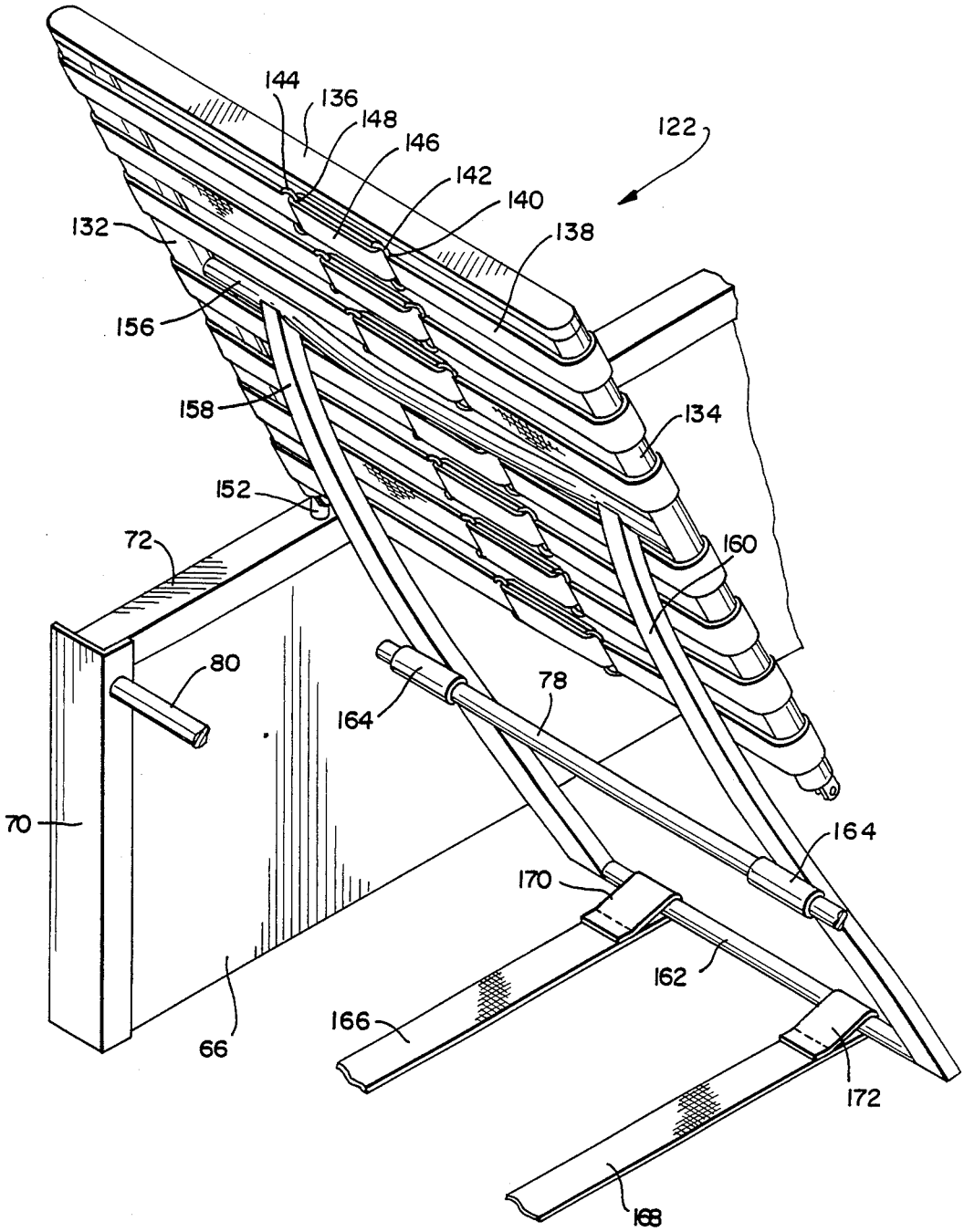
FIG. 6 is a partial perspective view showing the rear or under surface of the head support section of the mattress support frame and its attached head lift bars and head lift rod with attached head lift strap.

Head support section 122, as may be seen most clearly in FIG. 6 is provided with at least one transverse head support section tie bar 156. This tie bar 156 is securely attached at its ends to spaced head section right and left side tubes 132 and 134. Tie bar 156 is also somewhat concave shaped, so that it will not interfere with downward travel of a person support mattress once the patent is placed on the mattress. Also in some instances, the patient may be supported directly by the fabric web straps 138. Tie bar 156 is formed having a sufficient curve that it will also not be in the way of the patient's body.

Right and left head section lift bars 158 and 160, respectively are, as may be seen in FIG. 6, attached to head support section tie bar 156. These lift bars 158 and 160 extend generally downwardly and rearwardly from tie bar 156 and are generally parallel to, but inboard of right and left side head section tubes 132 and 134. These lift bars 158 and 160 are somewhat curved and act as support rockers for movable head support section 122. a head section lift rod 162 is attached to, and extends between the free ends of lift bars 158 and 160. When head support section 122 is properly secured to body lift frame assembly 24, the two lift bars 158 and 160 are supported by the transverse front intermediate body lift frame tie bar 78. Friction reducing rollers 164 may be placed about lift frame tie bar 78 to enhance movement of the head section lift bars 158 and 160 with respect to lift frame tie bar 78. This movement is accomplished by supplying a pulling force to spaced right and left head section lift straps 166 and 168. These lift straps are connected at first ends 170, 172 respectively to head section lift rod 162. A pulling force applied to these lift straps 166 and 168 by the modular power box assembly, as will be discussed subsequently, causes the free end of head support section 122 to move upwardly. If the pulling force is removed from lift straps 166 and 168, the weight of the head support section 122 either by itself, or in conjunction with the weight of the person being supported will cause the head support section 122 to return to a generally horizontal position.

Again referring to FIGS. 2 and 5, body support section 124 of mattress support frame assembly 28 has spaced right and left side tubes 174 and 176, respectively. These side tubes are connected by at least two transversely extending body support section tie bars 178 and 180. A plurality of fabric support webs 138 are spaced along the spaced sides tubes 174 and 176. The body support section 124, although it is relatively short, bears a substantial amount of the weight of the person being supported by the somatic support system. It is different from the other support sections in that it is the only section which is not movable other than vertically with the body lift frame assembly 24. Body support section 124 has downwardly extending attachment pins 182 at each end of each side tube 174 and 176. These pins 182 are receivable in cooperatively spaced holes 184 and 186 in downwardly opening channel members 72 and 90 of front and rear body lift segments 66 and 68, respectively. This allows body segment section 124 to be easily removed from body lift frame 24.

Knee support section 126 of mattress support frame assembly 28 has spaced right and left side tubes 188 and 190 and one or more transverse tie bars 192. As with the previously discussed two sections, knee support section 126 has a plurality of encircling fabric webs 138 which are connected at their ends by resilient straps 146, as may be seen more clearly in FIG. 7. Each end of both right and left side tubes 188 and 190 of knee support section 126 is provided with pivot ears 150. The forward or head ends of tubes 188 and 190 are pivotably connectable to hinge posts 194 carried by the top downwardly opening channel member 90 on rear body lift frame segments 68.

Figure 7:
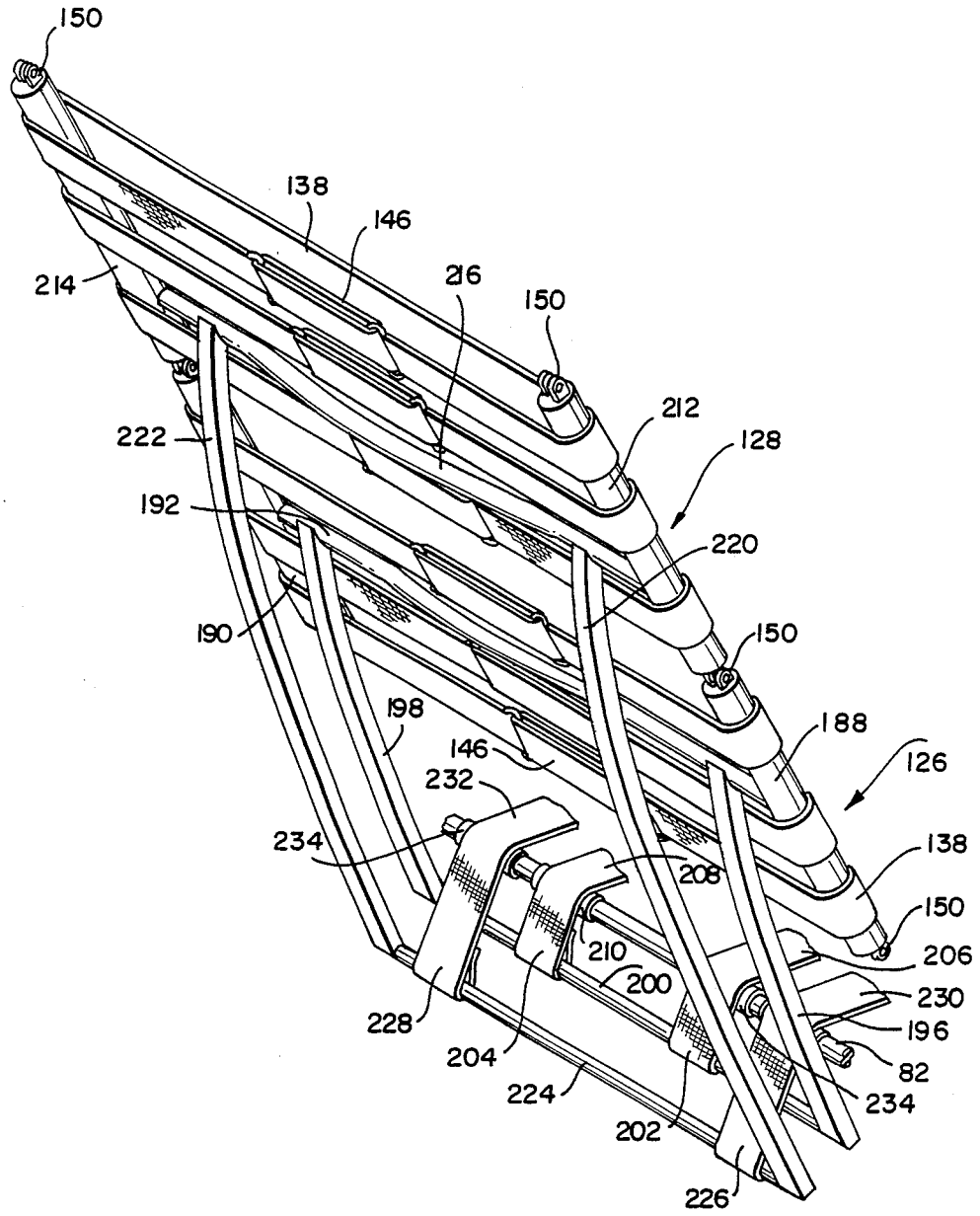
FIG. 7 is a partial perspective view of the knee and leg support sections of the mattress support frame with their associated lift bars, rods and straps.

Knee support section 126 has spaced knee lift bars 196 and 198, as may be seen most clearly in FIGS. 5 and 7. These knee lift bars 196 and 198 are attached at first ends to knee support section tie bar 192 and are joined at second, free ends by a knee section lift rod 200. This lift rod has secured thereto the first ends 202 and 204 of knee lift straps 206 and 208. As may also be seen in FIGS. 5 and 7, these knee lift straps 206 and 208 travel over the transverse rear body lift frame tie bar 82 which may be provided with suitable lift strap rollers 210. When a pulling force is exerted on knee lift straps 206 and 208, the right and left knee lift bars 196 and 198 will be caused to move upwardly with respect to rear body lift frame tie bar 82 thereby elevating the rear or foot end of knee support section 126 which will pivot about its pivot connections to pivot posts 194 on rear boy lift frame segment 68 of body lift frame assembly 24.

Leg support section 128 has spaced right and left side tubes 212 and 214 which are joined to each other by one or more leg support section tie bars 216. At its forward or head end, each leg support section side tube 212 and 214 has a pivot flange 218 which interfits between the spaced pivot ears 150 on the rear or foot end of knee section side tubes 188 and 190. Thus leg support section 128 is pivotably supported at its head or forward end to the rear or foot end of knee support section 126. Leg support section 128, similarly to the previously discussed three sections, is provided with a plurality of spaced fabric webs 138 whose ends are connected by resilient straps 146, as seen in FIG. 7. As also may be seen in FIG. 7, leg support section 128 carries a pair of spaced right and left leg lift bars 220 and 222. These leg lift bars 220 and 222 are attached at first ends to leg support section tie bar 216 and at their free ends carry a leg support section lift rod 224. First ends 226 and 228 of spaced leg lift straps 230 and 232 are attached to leg support section lift rod 224. A is shown in FIGS. 5 and 7, these leg section lift straps 230 and 232 also pass over spaced leg strap rollers 234 which are placed about rear body lift frame tie bar 82. As may be seen in FIG. 7, a pulling force exerted on leg section lift straps 230 and 232 will cause leg support section lift rod 224 and hence leg section lift bars 220 and 222 to move upwardly to elevate leg support section 128 about its pivotably connection to the rear or foot end of knee support section 126.

Figure 10:
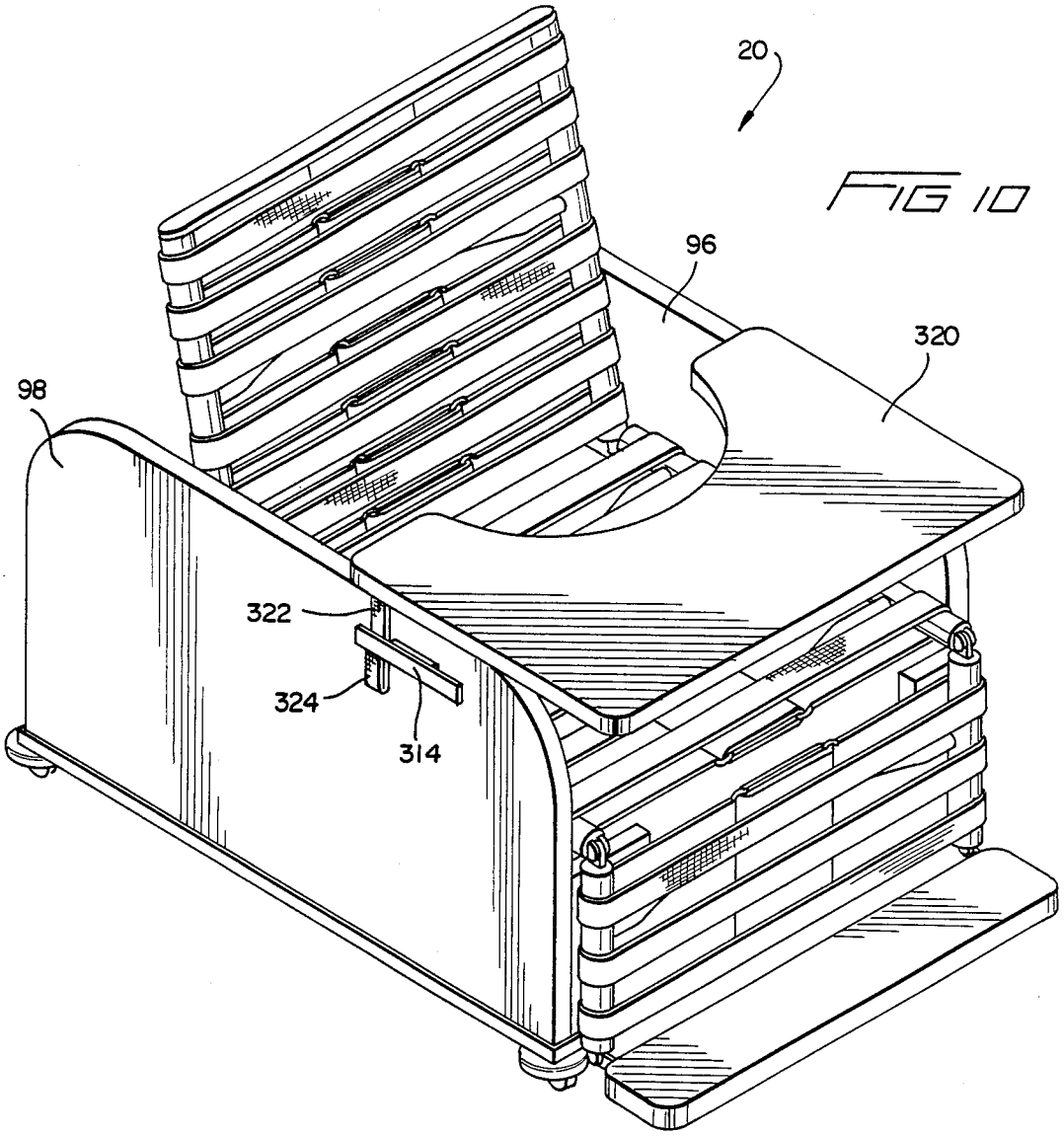
FIG. 10 is a perspective view generally similar to Fig. 9 but instead showing a work platform adjunct.

Foot support section 130, as may be seen in FIG. 2 is formed as a generally rectangular solid member 236 which is pivotably connected to the foot or rear end of leg support section 128. This may be accomplished by providing pivot flanges 238 on the forward end of the solid member 236. These flanges 238 will be secured between pivot ears 150 on the rear or foot portion of leg support section tubes 212 and 214. Although not specifically shown, it will be understood that foot support section 130 is provided with stop means or the lift to prevent the foot support section from falling below a generally horizontal position. Means may also be provided to secure foot support section 130 in an orientation where it is angled up to generally about 90° with respect to the upper surface of leg support section 128. This will allow foot support section 130 to act as a step or platform when the somatic support system 20 is used generally as a chair, as illustrated in FIGS. 9 and 10. Also by angling foot support section 130 with respect to the rest of the mattress support frame assembly 28, foot support section 130 can be used as a foot support for patients with a condition known as "foot drop". It will further be understood that, if desired, rectangular solid member 236 could be removed and a web belt foot support section 130 could be substituted therefor.

The modular power unit 30 supplies the necessary forces to pull the several lift straps discussed above to thereby raise and lower both the body lift frame assembly 24 and the various sections of mattress support frame assembly 28. This modular power unit 30 is shown by itself in FIG. 8 and its various power strap connections and orientations are shown most clearly in FIG. 5 which also shows modular power unit 30 in position as a part of somatic support system 20.

Referring initially to FIG. 8 it may be seen that modular power unit 30 is, as has previously been discussed, a generally rectangular unit having right and left side walls 112 and 114, and top and bottom walls 116 and 118. A pair of intermediate right and left upright panels 240 and 242 divide the interior of power unit 30 into three compartments. Four generally parallel lift strap shafts, which include a knee lift strap shaft 244, a leg lift strap shaft 246, a head lift strap shaft 248, and a body lift frame strap shaft 250 are carried within power box 30. Each of these shafts extends from right side wall 112 through intermediate right and left upright panels 240 and 242 to left side wall 114. By proper selection of the materials used for these walls and panels, it is possible to rotatably support the various strap shafts without the need for additional bearings or the like. Each shaft carries a strap shaft gear 254, 256, 258 and 260, respectively and each shaft is caused to rotate by a cooperating electric drive motor and gear box 264, 266, 268 and 270, respectively. These drive motors are mounted on the two intermediate panels with two of the four motors being mounted on each intermediate panel to balance the weight. Each motor drives a respective strap shaft drive gear 274, 276, 278 and 280, respectively. Thus each motor can be individually operated to drive its respective strap shaft drive gear which meshes with its associated strap shaft gear and thereby to cause the attached strap shaft to rotate in either a strap retracting direction or a strap extending direction.

As may also be seen in FIG. 8 each strap shaft 244, 246, 248 and 250 carries two rolls of strapping generally adjacent right and left power box side walls 112 and 114. For ease of understanding, these straps will be numbered similarly to their mattress support frame sections and body lift frame operating portions. Thus knee lift strap shaft 244 carries second ends of the right and left knee lift shafts 206 and 208; leg lift strap shaft 246 carries second ends of the right and left leg lift straps 230 and 232; and head lift strap shaft 248 carries second ends of the right and left head lift straps 166 and 168.

Body lift frame shaft 250 carries second ends of right and left body lift frame straps 282 and 284, respectively. As may be seen in FIGS. 2 and 5 these lift straps are somewhat different than the other three sets of straps. Where the other lift strap sets each have a first end which engages a single lift rod 162, 200 or 224, the first ends of the body lift frame lift straps 282 and 284 each engage the front lift bar tie rod 92 and the rear lift bar tie rod 94. This is accomplished by attaching front lift bar tie rod engaging strap loops 286 and 288 intermediate the ends of straps 282 and 284, and by attaching rear lift bar tie rod engaging strap loops 290 and 292 on the first ends of straps 282 an 284. As may also be seen in FIGS. 2 and 5, these body lift frame straps pass around right and left pulley or roller assemblies 294 and 296 attached to foot unit cross rail 38 of unit frame assembly 22. Thus as body lift frame drive motor 270 is operated and retracts or rolls body lift frame lift belts 282 and 284 onto body lift frame strap shaft 250, the lower ends 58 and 60 of the body lift frame lift bars 50 and 52 are caused to spread apart thereby elevating the entire body lift frame assembly 24.

Modular power unit 30 is supplied with electricity to operate the four small, efficient electric drive motors 264, 266, 268 and 270 through a single electric power supply cord 300 which enters the power unit 30 and is then branched to the four motors. A hand held remote controller (not shown) is joined by a control cord 302 to power unit 30. Both of these cords are modular and quickly detachable from power unit 30. Both of these cords further are position so that they will not interfere with the caster wheels 42 and can be kept out of reach of a bed user who might not be either physically able or mentally competent to operate the control for the motors.

While the modular power unit 30 has been discussed above as being powered by electric motors, other power means could also be used. For example, if desired the power unit 30 could utilize pneumatic or hydraulic motors if it were to be used in an atmosphere in which electric motors would be inappropriate. Alternatively, each of the shafts could be provided with a crank receiving socket so that the power unit would be manually operable. Similarly, the somatic support system 20 could be supplied with both an electrically operated power unit 30 and a manual unit so that the somatic support system could be used both in locations where power is readily available; i.e., within a house, and also where it is not available.

In keeping with the concept that the somatic support system 20 be modular for ease of assembly and shippage, it will be seen in FIG. 5 that each of the lift straps is provided with a strap connector assembly 304. If the somatic support system 20 is to be taken apart, the straps are separated at these straps connections 304 so that the various sections of the mattress support frame assembly 28 can be disconnected from each other, the body lift frame assembly 24, and the power module 30. Once these sections which form the mattress support frame assembly have been removed from the body lift frame assembly 24, it can, in turn be raised upwardly until the lift bars 50 and 52 separate from the body lift panel segments 66 and 68. These segments can then be separated. Next the side panels 96 and 98 and the rear panel support frame 104 can be separated from the unit frame assembly 22 by merely pulling them upwardly. In a similar manner, power unit 30 can also be separated rom unit frame 22 since its straps have been disconnected from the body lift frame 24 and the mattress support frame 28. Once unit frame 22 is by itself, it can be further broken into two halves, as was discussed earlier. Also, the body lift frame assembly 24 can be further subdivided, as was also previously discussed.

Figure 11:
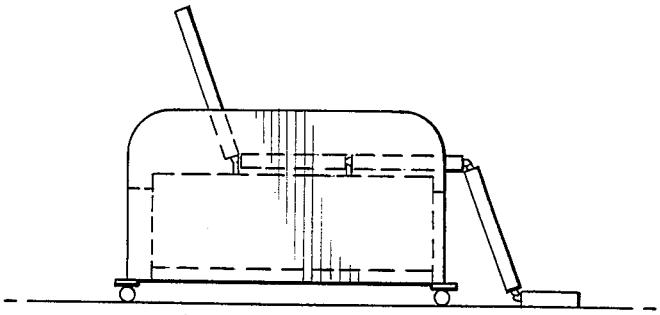
FIGS. 11–16 are schematic side views of the somatic support system of the present invention and showing the mattress support frame in various ones of its possible positions.
Figure 12:
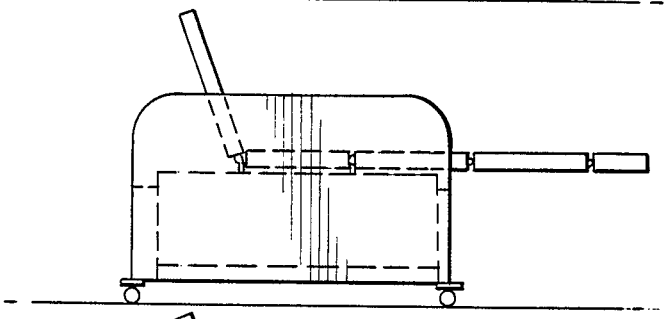
Figure 13:
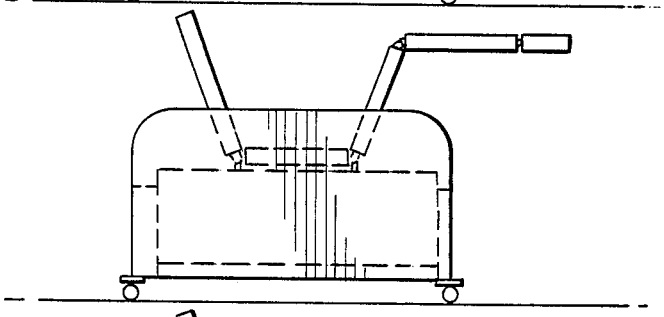
Figure 14:
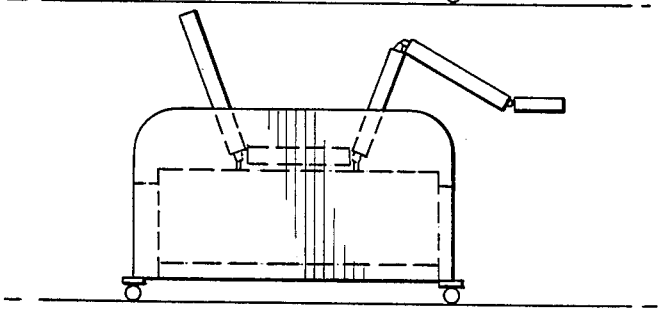
Figure 15:
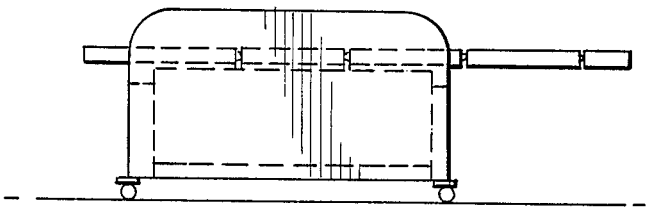

The somatic support system support 20 of the present invention can be used to support a person in a generally prone position at any number of heights from bed height to gurney height, and to elevate either the upper or lower portions of the person's body through a virtually infinite number of positions, as depicted schematically in FIGS. 12 through 16. It can also be used as a chair, as seen in FIG. 11 and further can be utilized with various patient care adjuncts, two of which are shown in FIGS. 9 and 10.

Bed-ridden persons have typically needed to use a bed pan since they cannot get out of bed to use a conventional toilet. Bed pans are difficult to use since it is often not easy to get the person onto and off the pan. They are also difficult to clean. As may be seen in FIG. 10, a commode seat 310 may be supported between the spaced right and left outer panels 96 and 98 by engagement of commode seat straps 312 with utility support strips 314 that are securely attached to the outer sides of the outer panels 96 and 98. A receptacle such as an open pan 316 can be placed beneath the commode seat. This pan 316 need not be a bed pan.

Figure 16:
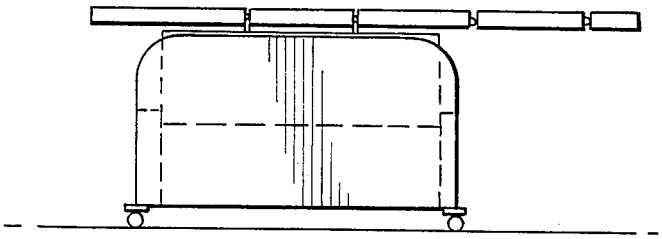

When the bed-ridden person desires to use the commode seat 310, the mattress support frame assembly 28 may be put in a generally planar orientation and elevated generally to the position shown in FIG. 16. The commode seat 310 will then be slid under the patient and its straps affixed to the utility support strips 214. Once this has been done, the head support section 122 can be elevated and the knee and leg support sections 126 and 128 can be moved downwardly to provide a chair-like support for the patient, as depicted in FIG. 9. Now the body lift frame assembly is lowered so that the weight of the patient is taken up by the commode seat. After the body lift frame assembly has been lowered to space the commode seat from the mattress support frame assembly, pan 316 can be put in place. After use, pan 316 can be removed and cleaned and the patient returned to his position on a mattress which is placed atop the mattress support frame assembly 28. Alternatively, a sitz bath pan can be placed beneath commode seat 310 for use by the patient.

It is often necessary to change the bed linen of a bed-ridden patient. This task is greatly simplified by the somatic support system of the present invention. With the person seated on the commode seat 310, and with the body lift frame assembly lowered, thereby placing the somatic support system generally in the configuration shown in FIG. 9, a mattress (not shown) can be slid out from beneath the person. The bedding on the mattress, or the mattress itself, can be changed and slid back into place. Alternative with the body lift frame assembly raised, as in shown in FIG. 16, an auxiliary support assembly, such as a web sling having elongated rigid side bars, may be placed under the patient. The rigid side bars are then attached to the utility support strips 314 and the body lift frame assembly 24 is lowered. This takes the patient off the mattress carried by the mattress support frame assembly. The mattress can then be slid off the support frame assembly and new bedding put on. If desired, a shallow light weight water containing receptacle could be temporarily placed on the mattress support frame assembly 28 and the patient could be bathed before being returned to bed.

An alternate use of somatic support system 20 is depicted in FIG. 10. A work platform 320 may be placed atop the right and left outer side panels 96 and 98. A pair of downwardly extending bars 322 or straps having enlarged lower portions 324 may be placed under the utility support strips 314. This provides the bed's occupant with a surface for eating, reading, writing, or other activities. This platform 320 may also act as an aid in keeping the person in a seated position since it will abut the person's midsection and prevent the person from either falling forward or sliding under the work platform 320.

The somatic support system 20 of the present invention provides a total body support system which is intended primarily for use with a bed-dependent person. The support system is capable of assuming a virtually infinite number of positions and can function as either a bed or a chair. It makes care of the bed-dependent person easier by facilitating bathing, linen changes, commode seat useage, positioning of the person in the bed and the like. By removing he mattress which will typically be placed on the fabric belts and by positioning the person directly on the belts, the somatic support system 20 will help reduce bed sores and skin ulcers and will further aid in patient care and will improve patient comfort. The somatic support system of the present invention can be readily taken apart and transported or shipped by common carrier. Since it is a modular system, individual parts can abe replaced, if necessary, without disabling the whole system. The somatic support system of the present invention provides anew an unique system of the support and care of the bed dependent person in a manner which is a significant improvement over prior devices.

While a preferred embodiment of a somatic support system in accordance with the present invention has been set forth fully and completely hereinabove, it will be apparent to one of ordinary skill in the art that a number of changes in, for example the overall size of the system the types of materials used, the specific type of electric drive motors and gear assemblies, the type of fabric belts, the type of resilient belts, the shapes of the various adjuncts and the like could be made without departing from the true spirit and scope of the invention which is accordingly to be limited by the following claims.

What is claimed is:

1. A somatic support system usable for the support of a bed dependent person, said somatic support system comprising:

a unit frame assembly having spaced side and end rails;

a body lift frame assembly removably supported by said unit frame and movable vertically with respect to said unit frame;

a panel assembly removably supported on said unit frame and including means for defining a path of vertical travel for said lift frame assembly;

a mattress support frame assembly removably secured to an upper portion of said body lift frame assembly, and drive means removably carried by said unit frame and operable to vary the position of said body lift frame assembly and said mattress support frame assembly.

2. The somatic support system of claim 1 wherein said unit frame assembly is disassemblable into two unit frame subassemblies.

3. The somatic support system of claim 1 wherein said unit frame assembly is supported by caster wheel assemblies.

4. The somatic support system of claim 1 wherein said body lift frame assembly includes right and left spaced body lift frame segments.

5. The somatic support system of claim 4 wherein each of said body lift frame segments if formed by a front and a rear separable segment.

6. The somatic support system of claim 4 wherein upper ends of spaced front and rear body lift bars are positionable in front and rear portion so said right and left body lift frame segment.

7. The somatic support system of claim 6 wherein spaced lower ends of said front and rear body lift bars carry body lift bar rollers which are positionable on said side rails of said unit frame assembly.

8. The somatic support system of claim 6 wherein spaced lower ends of each said front and said rear body lift bars are connected by transverse front and rear lift bar tie rods.

9. the somatic support system of claim 8 wherein said front and rear lift bar tie rods are connected to first ends of spaced body lift frame straps.

10. The somatic support system of claim 9 wherein second ends of said body lift frame straps are connected to said drive means.

11. the somatic support system of claim 1 wherein said removable panel assembly includes spaced right and left outer panels and a rear panel support frame.

12. The somatic support system of claim 11 wherein said right and left outer panels each include front and rear guide angle members, said guide angle members defining said path of vertical movement of said body lift frame assembly.

13. The somatic support system of claim 11 wherein said rear panel support frame is generally U-shaped and includes spaced legs, said legs abutting inner surfaces of rear portions of said spaced right and left outer panels.

14. The somatic support system of claim 11 wherein said right and left outer panels and said rear panel are removably supported on said side and end rails of said unit frame by placement between outer walls of said side and end rails and spaced roller guide rails and cross rail connectors.

15. The somatic support system of claim 1 wherein said mattress support frame assembly includes a head support section, a body support section, a knee support section, leg support section, and a foot support section.

16. The somatic support system of claim 15 wherein each of said mattress support frame sections includes spaced right and left side tubes.

17. The somatic support system of claim 16 wherein said right and left side tubes of each said section are spaced from each other by at least one transverse tie bar.

18. The somatic support system of claim 16 wherein each said mattress support frame section carries a plurality of spaced, transverse fabric support webs extending as loops between and around said right and left side tubes.

19. The somatic support system of claim 18 wherein each of said fabric support webs includes spaced ens secured together by a resilient, adjustable strap.

20. The somatic support system of claim 15 wherein selected ones of said sections of said mattress support frame assembly are pivotably attached to said body lift frame assembly.

21. The somatic support system of claim 15 wherein selected ones of said sections of said mattress support frame assembly are provided with lift bars and a lift rod.

22. The somatic support system of claim 21 wherein each said lift rod of each said selected section of said mattress support frame assembly is joined to said drive means by spaced straps.

23. The somatic support system of claim 1 wherein said drive means includes a plurality of elongated rotatable drive shafts.

24. The somatic support system of claim 23 wherein each of said shafts carries spaced straps which are connectable as first ends to a selected one of said body lift frame assembly and said mattress support frame assembly, and which are connectable at second ends to one of said shafts for extension and retraction by rotation of said shafts.

25. The somatic support system of claim 23 wherein said drive shafts are each caused to rotate by an electric motor.

26. The somatic support system of claim 1 wherein said somatic support system further includes a removably attachable patient care adjunct.

27. The somatic support system of claim 26 wherein said patient care adjunct includes spaced straps.

28. The somatic support system of claim 27 wherein said straps are attachable to utility support strips positioned on outer side panels of said panel assembly.

29. The somatic support system of claim 26 wherein said patient care adjunct is a commode seat.

30. The somatic support system of claim 26 wherein said patient care adjunct is a work platform.

* * * * *